US005926147A

United States Patent [19]

Sehm et al.

[11] Patent Number: 5,926,147

[45] Date of Patent: Jul. 20, 1999

[54] PLANAR ANTENNA DESIGN

[75] Inventors: Tomas Sehm; Arto Lehto, both of Helsinki; Antti Räisanen, Espoo, all of Finland

[73] Assignee: Nokia Telecommunications Oy, Espoo, Finland

[21] Appl. No.: 08/836,115

[22] PCT Filed: Aug. 23, 1996

[86] PCT No.: PCT/FI96/00455

§ 371 Date: Apr. 22, 1997

§ 102(e) Date: Apr. 22, 1997

[87] PCT Pub. No.: WO97/08775

PCT Pub. Date: Mar. 6, 1997

[30] Foreign Application Priority Data

Aug. 25, 1995 [FI] Finland ..... 954012

[51] Int. Cl.[6] ..... H01Q 13/02

[52] U.S. Cl. ..... 343/776; 343/778; 343/786; 343/771; 343/772; 343/777

[58] Field of Search ..... 343/776, 778, 343/777, 780, 786

[56] References Cited

U.S. PATENT DOCUMENTS

| | | | |
|---|---|---|---|
| 4,096,482 | 6/1978 | Walters | 343/778 |
| 4,743,915 | 5/1988 | Rammos et al. . | |
| 5,568,160 | 10/1996 | Collins | 343/778 |

FOREIGN PATENT DOCUMENTS

| | | |
|---|---|---|
| 205 212 | 12/1986 | European Pat. Off. . |
| 213 646 | 3/1987 | European Pat. Off. . |
| 2 408 610 | 9/1974 | Germany . |

*Primary Examiner*—Robert H. Kim
*Assistant Examiner*—Layla G. Lauchman
*Attorney, Agent, or Firm*—Pillsbury Madison & Sutro LLP

[57] ABSTRACT

An antenna design includes a plurality of radiating elements which radiate electro-magnetic energy, and feeders which feed the electromagnetic energy to the radiating elements. The feeders have a supply network substantially at the same level in the antenna thickness direction. In order to achieve a small antenna with adequate properties for radio link usage, the radiating elements are arranged next to the supply network in the thickness direction and include box horn antennas which have a step, characteristic of a box horn, in the plane of the magnetic field.

14 Claims, 6 Drawing Sheets

PLANAR ANTENNA DESIGN

This application is the national phase of international application PCT/FI96/00455 filed Aug. 23, 1996 which designated the U.S.

FIELD OF THE INVENTION

The present invention relates to an antenna design, particularly, for radio link applications.

BACKGROUND OF THE INVENTION

Currently, radio links employ several frequency bands on VHF (30 . . . 300 MHz), UHF (300 MHz . . . 3 GHz), SHE (3 . . . 30 GHz), and EHF (30 . . . 300 GHz) bands. Ever higher frequencies have been used because mobile services have almost entirely used the lower frequency bands (below 3 GHz). Presently, many radio link systems operate in the 38 GHz frequency range, which, at least initially, is the range for the antenna according to the present invention. As the principle of the antenna is not in any way tied to frequency, the antenna design of the invention is intended for use in the micro and millimeter ranges.

Radiation characteristics required of radio link antennas are specified in international standards. For example, the ETSI (European Telecommunications Standards Institute) standard prETS 300 197 specifies the highest levels permitted to side lobe levels in the radiation pattern of a 38 GHz radio link antenna. Thus, the starting point of designing radio link antennas is typically such that the antenna gain must be higher than a specific minimum level, but also such that the side lobe levels remain lower than specific limits. The gain cannot, therefore, be increased indefinitely because it would increase the side lobe levels accordingly.

Requirements set for radio link antennas are strict, and, on frequencies presently used, the radiation characteristics specified in the standards have successfully been fulfilled only with different kinds of horn plus lens or reflector antennas (parabolic antennas).

Apart from adequate radiation characteristics, antenna manufacturers and especially antenna users (customers) desire physically small antennas. Particularly when the terminal point of the radio link is at the customer's site, it is important for the antenna to blend into the background as well as possible (i.e., fit into a small space).

Laws of physics largely determine the antenna cross sectional area. In other words, the antenna must have a specific capture area or its aperture must have specific dimensions. Instead, through structural design, dimensions of the antenna in the thickness direction can be modified. For example, the drawback of the aforementioned horn plus lens or reflector antennas is that these antennas cannot be made compact due to their operating principle. In the aforementioned 38 GHz range, for example, such antennas are at least on the order of 20 cm thick.

Small dimensions in the thickness direction can be obtained by planar antennas (a planar antenna refers to a design in which the feeders and reflector elements of the antenna are very close to one another in the thickness direction). Planar antenna designs are often based on microstrip technique, which results in an insufficient gain due to the high loss of the microstrip structure. Many planar antenna designs also share the drawback of being narrow-band (required characteristics are only obtained on a narrow frequency band). Some planar antennas also have the disadvantage of being unsuitable for mass production due to the very strict dimensioning requirements on the higher frequencies used today. Antenna manufacturers desire an antenna design that can be mass produced.

SUMMARY OF THE INVENTION

It is an object of the present invention to avoid the above drawbacks by providing a new type of an antenna structure which is suitable for radio link use, has sufficient radiation characteristics, is compact, and is suitable for mass production. These objects are achieved by an antenna design of the invention, which has a plurality of radiating elements and feeders.

Such an antenna has specific properties (such as allowing a planar structure, low losses, and wideband operation) through a planar supply network, and incorporates known box horns by radiation characteristics that obviate the above drawbacks as radiating elements. Relating to the present invention, by optimal dimensioning of the box horn in a way suitable even for mass production, it is possible to set the radiation pattern null of a single radiating element to the direction where the array factor indicates a side lobe for the antenna array. In this manner, the side lobe of the antenna array can easily be eliminated, whereby the desired radiation characteristics can be obtained without difficulty.

The present invention provides a planar design with good (adequate for radio link use) radiation characteristics, a simple structure, low manufacturing costs, and insensitivity to manufacturing flaws. For example, in the aforementioned 38 GHZ range, the antenna according to the present invention is only approximately 4 cm thick, i.e., in practice about one fifth of the minimum thickness of current radio link antennas.

Even though the whole antenna is constructed, according to a preferred embodiment of the invention, by waveguide techniques, a planar structure is still obtained.

BRIEF DESCRIPTION OF THE DRAWINGS

In the following, the invention and its preferred embodiments will be described with reference to the examples in the attached drawings, in which.

DETAILED DESCRIPTION OF PREFERRED EMBODIMENTS

Figure 1:
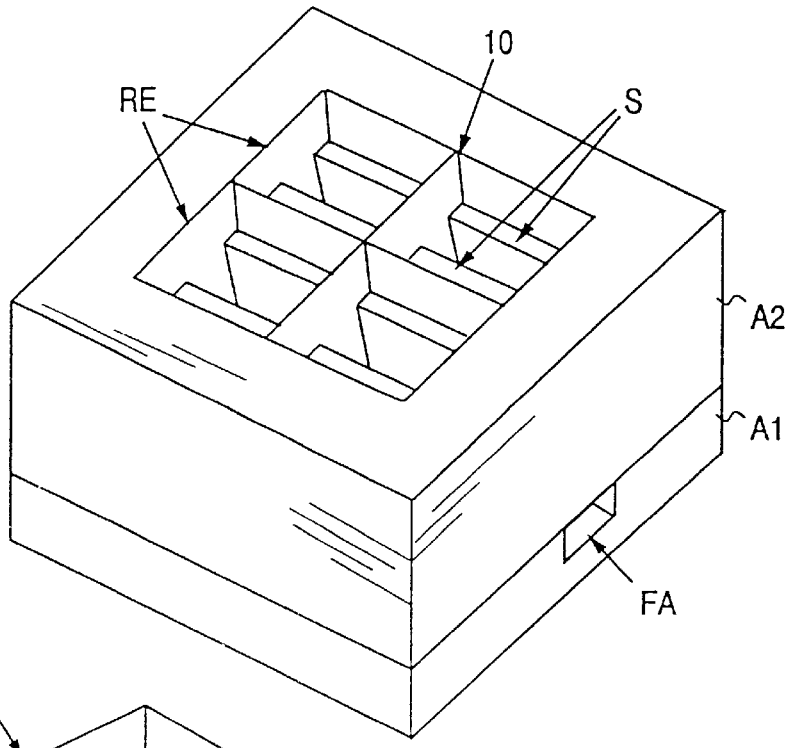
FIG. 1 shows a perspective view of the antenna according to the present invention, which has 2×2 radiating elements.

FIG. 1 shows an antenna according to the present invention. The antenna comprises two parts, part A1 which contains the supply network, and part A2 which is attached on top of part A1 and contains the radiating element array 10 which (due to reasons of clarity), in this example, has only four radiating elements RE next to one another in a compact manner (two in both planes). Each radiating element RE is a box horn with a step S in the plane of the magnetic field. A feed aperture leading to the supply network is marked with reference mark FA. Both the antenna parts (A, and A2) may be, e.g., closed metal parts that have been produced, e.g., by casting (the manufacturing technique of the antenna will be described in closer detail below).

Figure 2A:
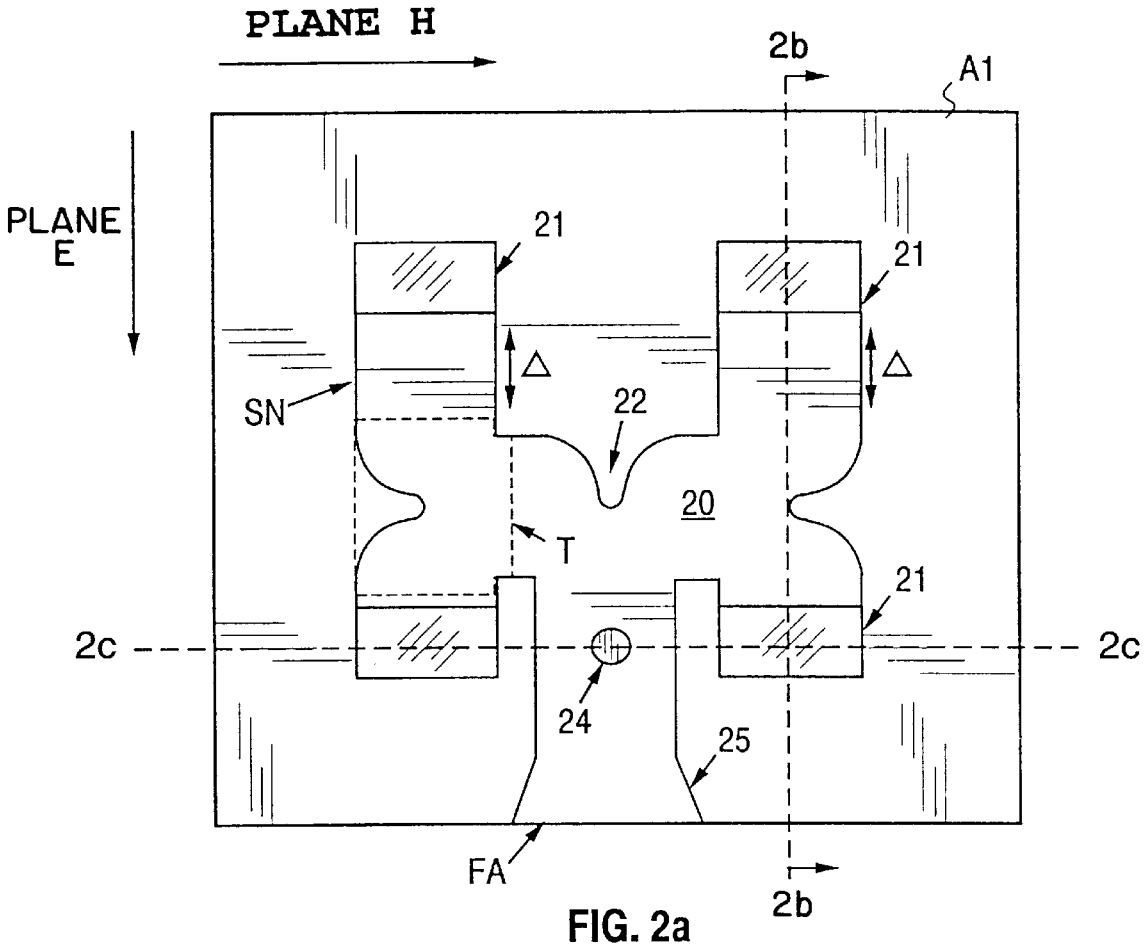
FIGS. 2*a*–2*c* illustrate a supply network used in the antenna design of FIG. 1.
Figure 2B:
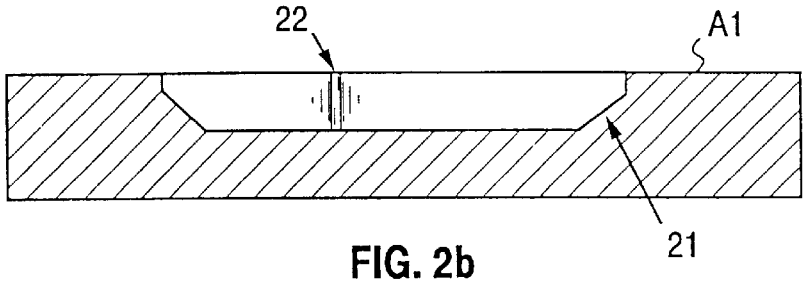

FIG. 2*a* shows a top view of the lower part (A1) illustrated in FIG. 1, i.e., the face which is placed against part A2. FIG. 2*b* shows part A1 viewed in 15 the direction of line 2B—2B of FIG. 2*a*, and FIG. 2*c*, in the direction of line 2C—2C. This case uses a rectangular waveguide as a feeder. Using a rectangular waveguide as a feeder is a very advantageous choice due to its simple structure and low losses. The more complicated the structure, the more expensive it is to manufacture, and in most cases, the more prone to manufacturing flaws. The waveguide includes a slot 20 provided on the surface of part A1, and part A2 forms the ceiling of the waveguide. It is advantageous to have as narrow a waveguide as possible to obtain as narrow as possible spacing between the radiating elements (element spacing), and consequently, few side lobes for the antenna array. Thus, a narrow waveguide is advantageous from the standpoint of operating and cut-off frequencies.

In the aforementioned 38 GHz range, a waveguide width of approximately 5 mm can be chosen, whereby, e.g., waveguide WR-28 having the width of 7.11 mm and height of 3.56 mm may be chosen for a standard waveguide (not shown) feeding the antenna. It is thereby possible to choose the depth D of slot 20 provided in part A1 to correspond to the height of the waveguide being used. For the feeding waveguide, an extension 25 is provided at the feed aperture FA. The extension forms a transition from the wider waveguide to the narrower.

The waveguide operates solely on the lowest mode $TE_{10}$. For example, in the waveguide WR-28, the cutoff frequency of $TE_{20}$ mode is 60 GHz, and that of the $TE_{01}$ is 42.13 GHZ, which means that these wave modes cannot propagate in the waveguide when the antenna is used on 38 GHz.)

Figure 3A:
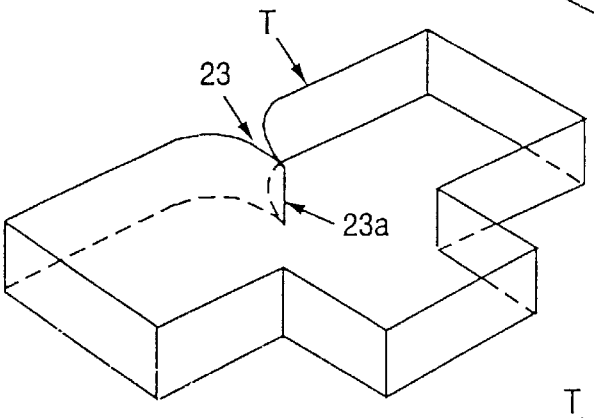
FIG. 3*a* illustrates a curved divider of the waveguide T-junction.
Figure 2C:
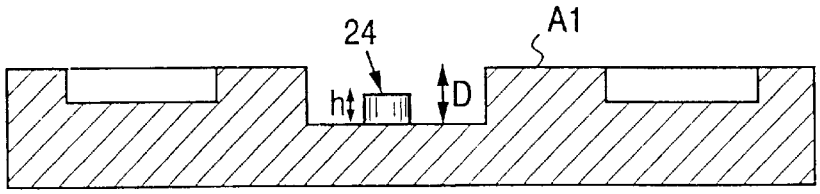

In a planar supply network according to FIGS. 2*a*–2*c*, the power supplied from a common supply source (not shown) is divided by successive T-junctions to different radiating elements. In the example of FIG. 2*a*, e.g., there are three T-junctions. One of them is marked by reference mark T, and the borders of the junction are indicated by broken lines. As a conventional T-junction has a high reflection coefficient in a waveguide, it is advantageous to employ a rounded divider 22, based on a triangular model, in the T-junctions of the supply network. Such a rounded divider is based on a known divider, illustrated in FIG. 3*a*, in which the tip 23*a* of the triangular divider 23 has been made extremely thin. Such a divider, with rounded sides and a thin tip, provides a low reflection coefficient. However, the design is sensitive to the position of the center point (tip 23*a*) of the divider. As a result, it is advantageous to use the rounded divider 22 described above and illustrated in FIG. 3*b*. As far as tip 23*a* is concerned, the ideal shape of the rounded divider has been altered by making the tip less sharp and sturdier, thereby making the divider less prone to manufacturing flaws. Good matching can nevertheless be maintained.

Figure 3B:
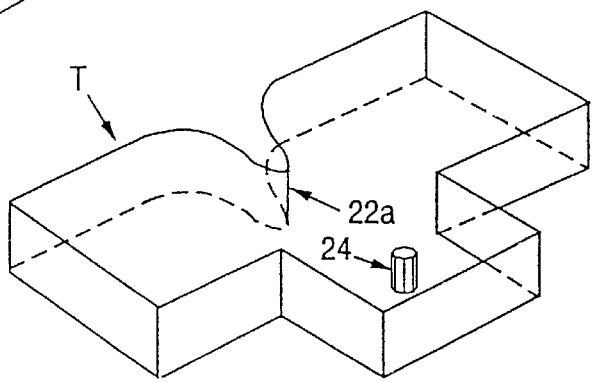
FIG. 3*b* illustrates a divider of the waveguide T-junction in which the divider has been optimized structurally from the divider of FIG. 3*a*.
Figure 3C:
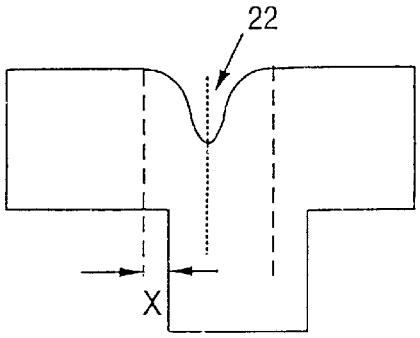
FIG. 3*c* illustrates a divider of the waveguide T-junction that provides an asymmetrical power distribution.

If it is necessary to deviate from evenly feeding the antenna array due to requirements concerning the antenna radiation pattern, the required power distribution ratios can be obtained in the T-junction by shifting the divider 22 in the middle of the junction off the center line. If such an asymmetrical power distribution between the elements is desired, it must be implemented without creating phase difference between the elements. In the T-junction, the phase difference between output gates increases in proportion to distance that the divider shifts further away from the center line. This phase difference equals the phase difference obtained if the position of the input gate is shifted sideways. Thus, phase is determined by distance to the divider, as measured from the output gates. This means that the phase difference can be compensated by shifting the position of the T-junction feeder guide an equidistance sideways to the same extent. This is illustrated in FIG. 3*c*, in which reference mark X denotes the distance of the sideways shift. As a result, the divider may be located in the center of the T-junction, but the feeder guide may be to the side in relation to the divider.

The matching of the power divider can further be improved by generating a second reflection which cancels the reflection from the divider. If the amplitude of the reflection that is purposely caused equals the reflection from the divider, and they have opposite phases, the total reflection summed will be zero. A reflection can be generated in the waveguide by placing an obstruction in it. In the example according to the figures, a cancelling reflection has been generated with a cylindrical tap 24 (as shown in FIG. 2*c* and FIG. 3*b*). The amplitude of the reflection can be affected by adjusting the height h of the tap, and by shifting the location of the tap (its distance from the power divider), it is possible to obtain a desired phase.

In addition to power distribution in the supply network, the waveguide must be curved. In FIGS. 2*a*–2*c*, the waveguide has a plane E curve in a waveguide branch leading to a single radiating element (below, the plane of the electric field will be referred to as plane E, and the plane of the magnetic field will be referred to as plane H). The curve has been implemented by providing the slots with sloping bevels of substantially 45 degrees. The bevels are denoted by reference numbers 21 in FIGS. 2*a* and 2*b*. Because this results in polarization that would otherwise have an opposite phase between adjacent radiating elements in plane E, a half wavelength prolongation Δ has been provided on one side. This reverses the signal to be cophasal with the signal of the adjacent element in the plane E. At the bevels, each feeder branch is coupled to the radiating element, i.e., part A2 has a hole in a corresponding location, which is the "feed aperture" of the radiating element.

In the plane E, the spacing between the radiating elements is largely determined by the phase correction required. At least the T-junction and phase correction (Δ) must fit between the elements. On both sides, there will be the curve in the plane E, and on the side where there is no phase correction, the curve cannot be placed right next to the T-junction because it disturbs the fields present in the T-junction. To assure reliable operation, the distance between the T-junction and the curve must in practice be at least one eighth of the wavelength.

The elements can be placed closer to one another in the plane H than in the plane E. If the walls between the waveguides in the supply network were extremely thin, the element spacing would be $d_H=2\times$ the waveguide width. In determining the spacing, it must, however, be noted (a) that the directivity (and therefore, gain) of the antenna array is at its highest when the element spacing is a multiple of $0.9\lambda$ ($\lambda$ is wavelength in free space), and (b) that the number of side lobes of the antenna array is proportional to how many wavelengths the element spacing represents. Thus, it is possible to increase the element spacing, for example, to $0.9\times2\times\lambda$, without increasing the number of side lobes. The directivity of the antenna array, thereby, increases to its maximum with element spacings wider than a wavelength.

By design solutions described above (T-junctions, power dividers, and tap matching, which are known solutions), a person skilled in the art is able to dimension the supply network according to the operating frequency arid other requirements set for the antenna at any one time. As far as the invention is concerned, the essential matter concerning the supply network is mainly its planar design and the possibility for a low-loss waveguide implementation. An advantageous detail is also represented by the possibility to taper (referring to decreasing the supply amplitude at the elements located at the edges of the array) the illumination over the antenna surface by dividers. The final supply network is formed by placing the power dividers to obtain a desired amplitude distribution for the radiating elements. Relative amplitudes of the elements are defined by computing the radiation pattern of the antenna array with different taperings. Due to the fact that tapering decreases the gain and widens the main beam, it is advantageous to aim at maintaining the illumination function as close as possible to an evenly illuminated aperture.

As set forth in the above, the antenna design in accordance with the invention uses a box horn as a radiating element. A box horn is a known horn antenna design, which has a greater directivity in the plane of the magnetic field (plane H) than does a conventional horn with an aperture of the same dimensions. The horn is constructed to generate a higher order (third) wave mode having a phase which deviates, e.g., 180 degrees, from the phase of the dominant mode in the antenna aperture. This higher order mode changes the aperture illumination (in the plane H) from a cosine type of an illumination towards one that more resembles an even illumination or two cosine illuminations.

Figure 4:
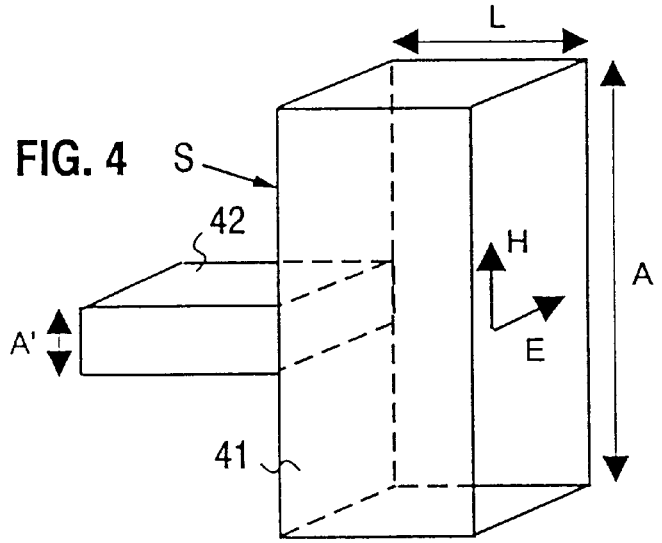
FIG. 4 illustrates the basic structure of a known box horn.

FIG. 4 illustrates the basic design of a known box horn. The horn typically includes a rectangular waveguide element 41, having length L. This part, which measures A in the plane H is referred to as a box. The value of A must be high to allow higher order wave modes $Te_{n0}$ (n=0 . . . 3) to propagate The horn is open at one end, and is fed from a rectangular waveguide 42 at the other end. The feed can also be carried out by a horn in the plane H (a waveguide whose aperture at the end has been extended in the plane H direction, while keeping the dimensions in the plane E unchanged). The feeding waveguide or horn, with an aperture A', is placed on the center line of the box in order to generate only wave modes with an amplitude deviating from zero at the center of the aperture, i.e., $TE_{10}$ and $TE_{30}$ modes. The ratio between the amplitudes of these wave modes is dependent on the apertures ratio A'/A. Assuming that $a_1$ is the amplitude of the $TE_{30}$ mode and $a_3$ is the amplitude of the $TE_{30}$ mode, their ratio can be presented as:

$$\frac{a_3}{a_1}=\frac{\int_{-\frac{A'}{2}}^{+\frac{A'}{2}}\cos\left(\frac{\pi x}{A'}\right)\cos\left(\frac{3\pi x}{A}\right)dx}{\int_{-\frac{A'}{2}}^{+\frac{A'}{2}}\cos\left(\frac{\pi x}{A'}\right)\cos\left(\frac{\pi x}{A}\right)dx}.$$

Figure 5:
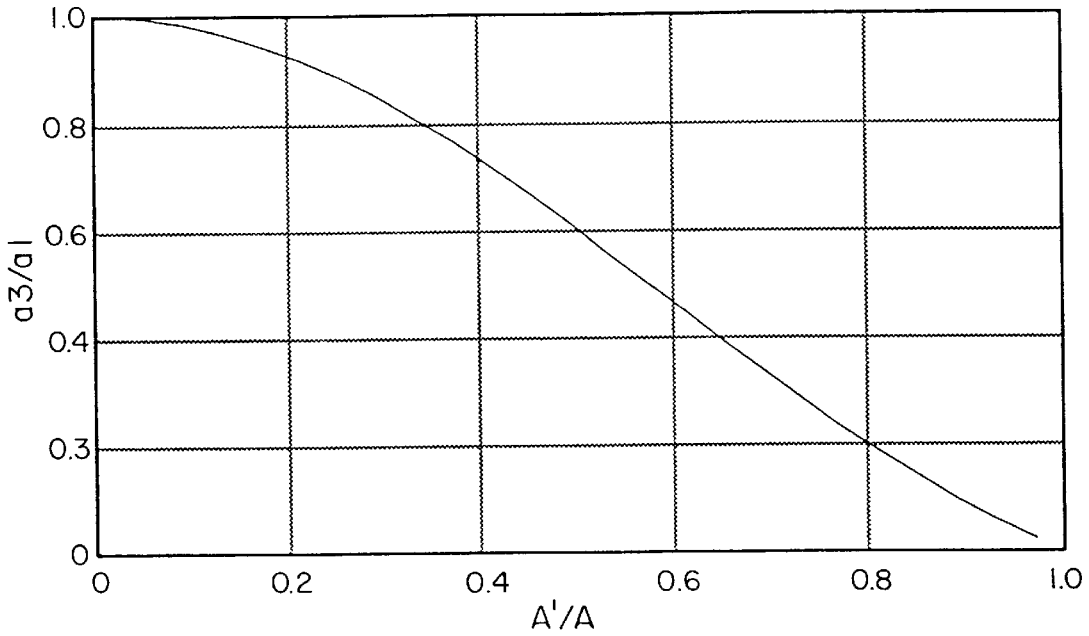
FIG. 5 shows how the ratio of the amplitudes of different wave modes in the box horn is dependent on the ratio of the box horn apertures.

Based on this dependence, the ratio between the amplitudes $a_3$ and $a_1$ can be illustrated as a function of step height A'/A. This is illustrated in FIG. 5.

Figure 6:
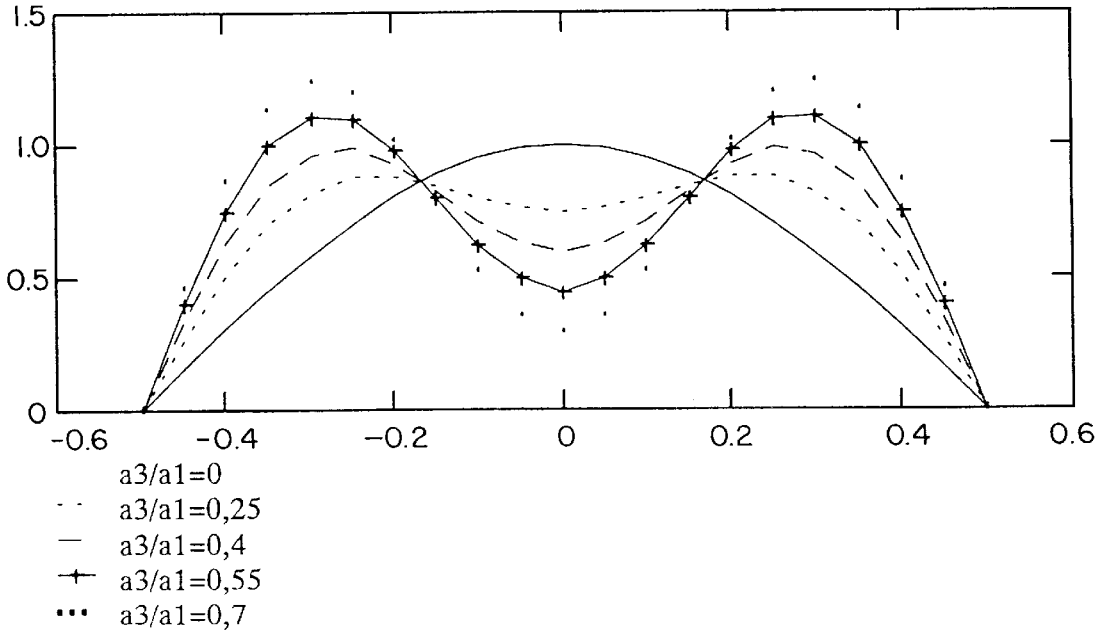
FIG. 6 shows the illumination of the box horn aperture.

The amplitude distribution of the box horn aperture (in plane H) also depends on the ratio $a_3/a_1$. FIG. 6 illustrates the amplitude distribution with values 0–0.7 for the ratio $a_3/a_1$. The horizontal axis represents perceptual distance from the aperture center point, and the vertical axis represents proportional level. It is assumed in the figure that the phase difference between two propagating modes at the aperture level is 180 degrees. As the figure shows, the amplitude ratio value of 0.35 provides a relatively good approximation for an even illumination function, and the value of 0.55 for two cosine distributions. In the plane E, the field is evenly distributed in the waveguide, and the area of the antenna aperture is evenly illuminated.

The antenna according to the present invention uses a box horn of the type described above, and particularly, one which has a step characteristic in the plane of the magnetic field. The step provides a simple means for changing the relative amplitudes of wave modes propagating in the horn.

The box horn for an antenna array according to the present invention is designed as follows. At first, the array factor is utilized in computing the direction where the array factor indicates a side lobe. The array factor, as known, is of the form:

$$f(\gamma)=\frac{1}{N}\left|\frac{\sin\left(\frac{N}{2}\gamma\right)}{\sin\left(\frac{1}{2}\gamma\right)}\right|,$$

where N is the number of elements, and $\gamma$ depends on the wavelength $\lambda$, element spacing d, and the angle of view $\theta$, as follows:

$$\gamma=kd\sin(\theta)+\delta,$$

where the wave number $k=2\pi/\lambda$ and $\delta$ represents phase difference between the elements.

In order to compute the direction of the side lobe, element spacing and frequency must be known. Element spacing is known based on the supply network dimensions.

By computing the radiation pattern of the box horn for different amplitude ratios, the amplitude ratio which has a null in the direction in which the array factor indicates a side lobe will be determined. The radiation pattern of an aperture antenna is determined by the field present at the aperture. A Fourier transformation can be used in computing the antenna radiation pattern when the field present at the aperture is known. Particularly, the radiation pattern can be defined as a Fourier transformation of the aperture distribution. Thus, if the function representing amplitude distribution is F(y), the radiation pattern can be computed as a function of angle $\phi$ in plane xy by the formula:

$$E(\phi) = \int_{-\frac{L}{2}}^{\frac{L}{2}} F(y) e^{j\beta y \sin(\phi)} dy,$$

where β represents a propagation coefficient and L is the dimension of the aperture in the measuring level. Hence, E(ϕ) represents a Fourier transformation of the function F(y).

After establishing the amplitude ratio at which the null of a single radiating element occurs in the same direction where the array factor indicates a side lobe, the amplitude ratio can be used to define the aperture ratio A'/A this amplitude ratio. Based on the aperture ratio, the radiating element can be given its final measures, because based on the ratio, the dimension of the step in the plane of the magnetic field is known. Accordingly, by using the size of the step, a desired radiation pattern has been obtained, after defining the step position which also has an influence on the result, for a single radiating element with a null in the direction in which the array factor indicates a side lobe.

Figure 7A:
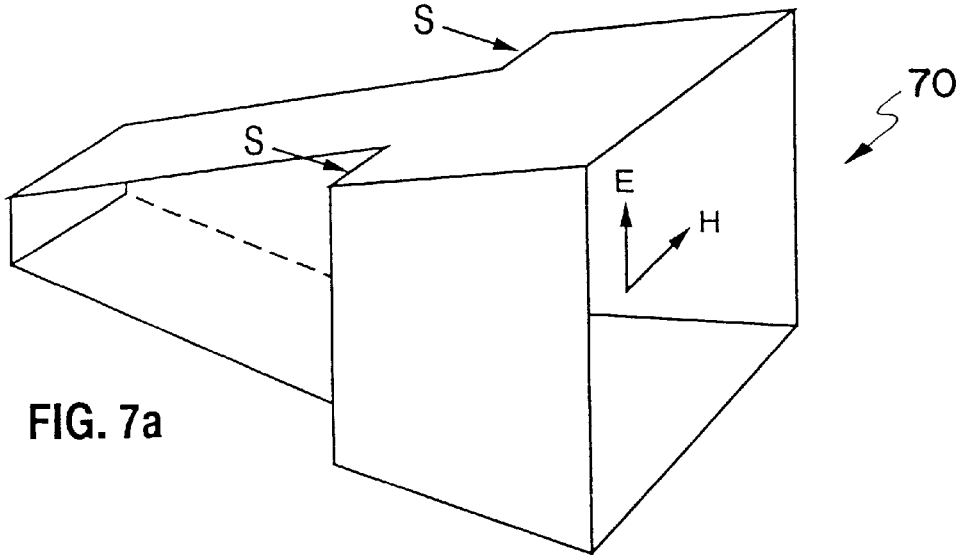
FIG. 7*a* shows the basic structure of a radiating element used in the antenna of FIG. 1.
Figure 7B:
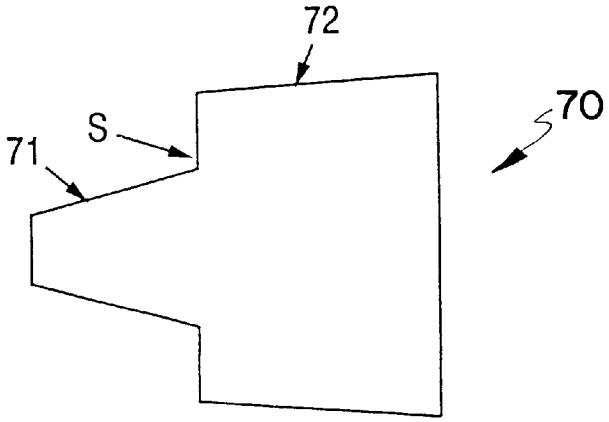
FIG. 7*b* illustrates a cross-section of the radiating element of FIG. 1 in plane H.
Figure 7C:
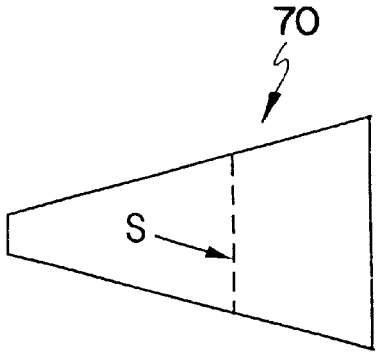
FIG. 7*c* illustrates a cross-section of the radiating element of FIG. 1 in plane E.

FIGS. 7*a*–7*c* illustrate the basic structure of a horn antenna 70, disclosed in FIG. 1 and used as a radiating element in the antenna according to the present invention. "Feed-throughs" matching the horn antennas will be provided in part A2. FIG. 7*a* shows a perspective view of the radiating element, FIG. 7*b* shows a cross-section of the element in plane H, and FIG. 7*c*, a cross-section of the element in plane E. In this example, the horn opens linearly in both the plane H and E. In the plane H. this holds true both prior to the step S (cf., face 71) and after the step S (cf., face 72). In such a design, with changing dimensions in the plane H, the propagation factor of the wave changes when travailing from the step to the aperture level. A design with an enlargement in the plane H after the step has the advantage that the aperture of the radiating element can be made as large as possible and yet the walls between the radiating elements can have a specific thickness for reasons of processibility.

In the above, those principles have been described according to which the antenna of the invention can be designed to match requirements set for it at any one time. By following the corresponding principles, the radiating element, for example, may be realized in a completely different shape. The radiating element may, e.g., open nonlinearly manner, or the enlargement may not be realized at all (this holds true for both the plane E and plane H). As far as manufacturing technique is concerned, the nonlinear enlargement is clearly worse than the linearly opening radiating element described above.

Figure 8:
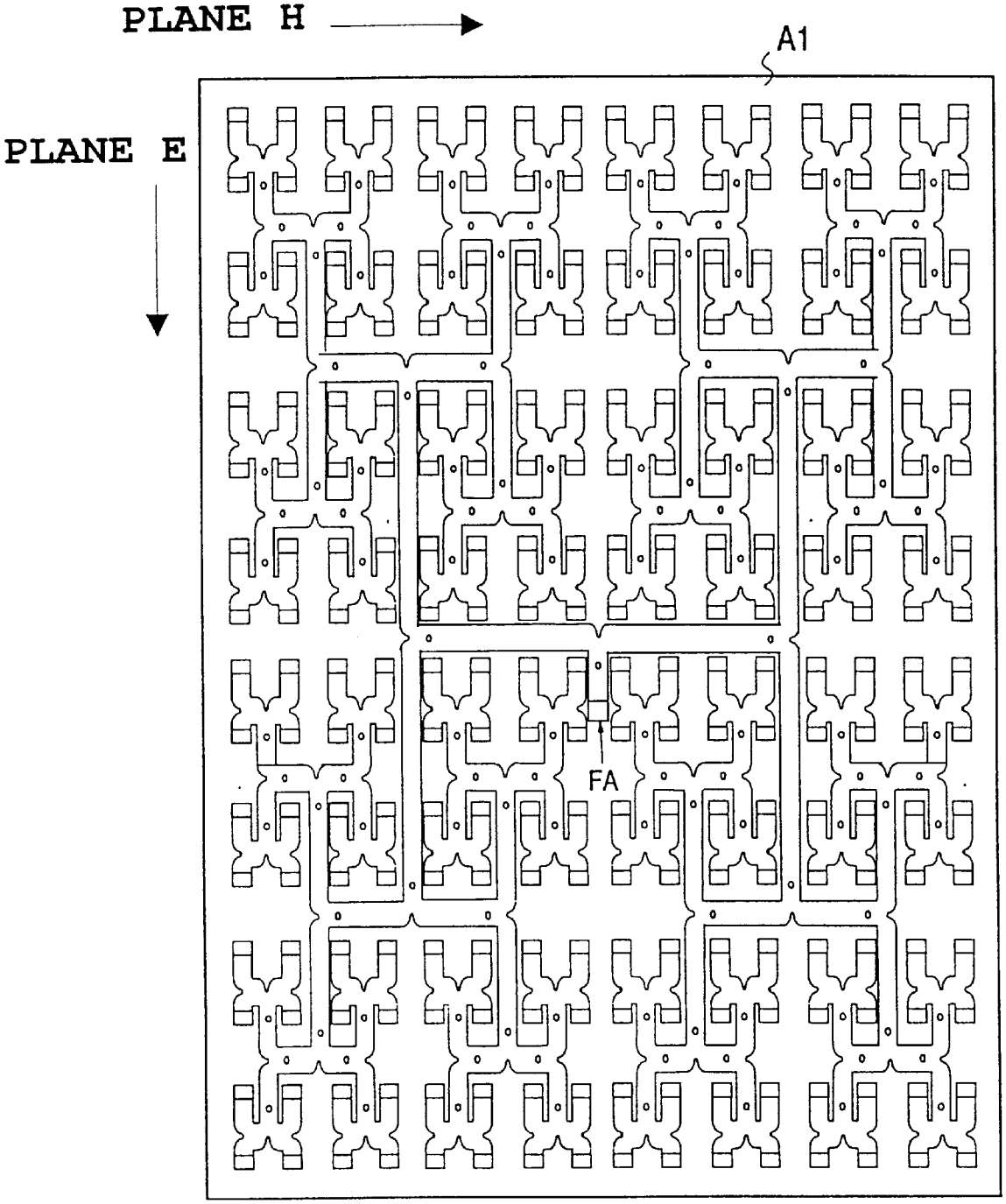
FIG. 8 shows a supply network intended for a 16×16 element array.

The number of radiating elements may also vary according to requirements set for the antenna. FIG. 8 shows a top view of a supply network for 256 elements, corresponding to the view of FIG. 2*a*. The feed aperture FA of the antenna in this case is in the middle of the supply network. As shown by the figure, the supply network in this case comprises 64 basic modules illustrated in FIG. 2*a*. Each module has four parallel feeding branches for four different radiating elements. In a preferred embodiment, the number of radiating elements equals a power of two (e.g., $2^8$=256), because this results in a symmetrical antenna design. The number of elements required depends on the gain, size, and radiation pattern requirements set for the antenna.

Figure 9:
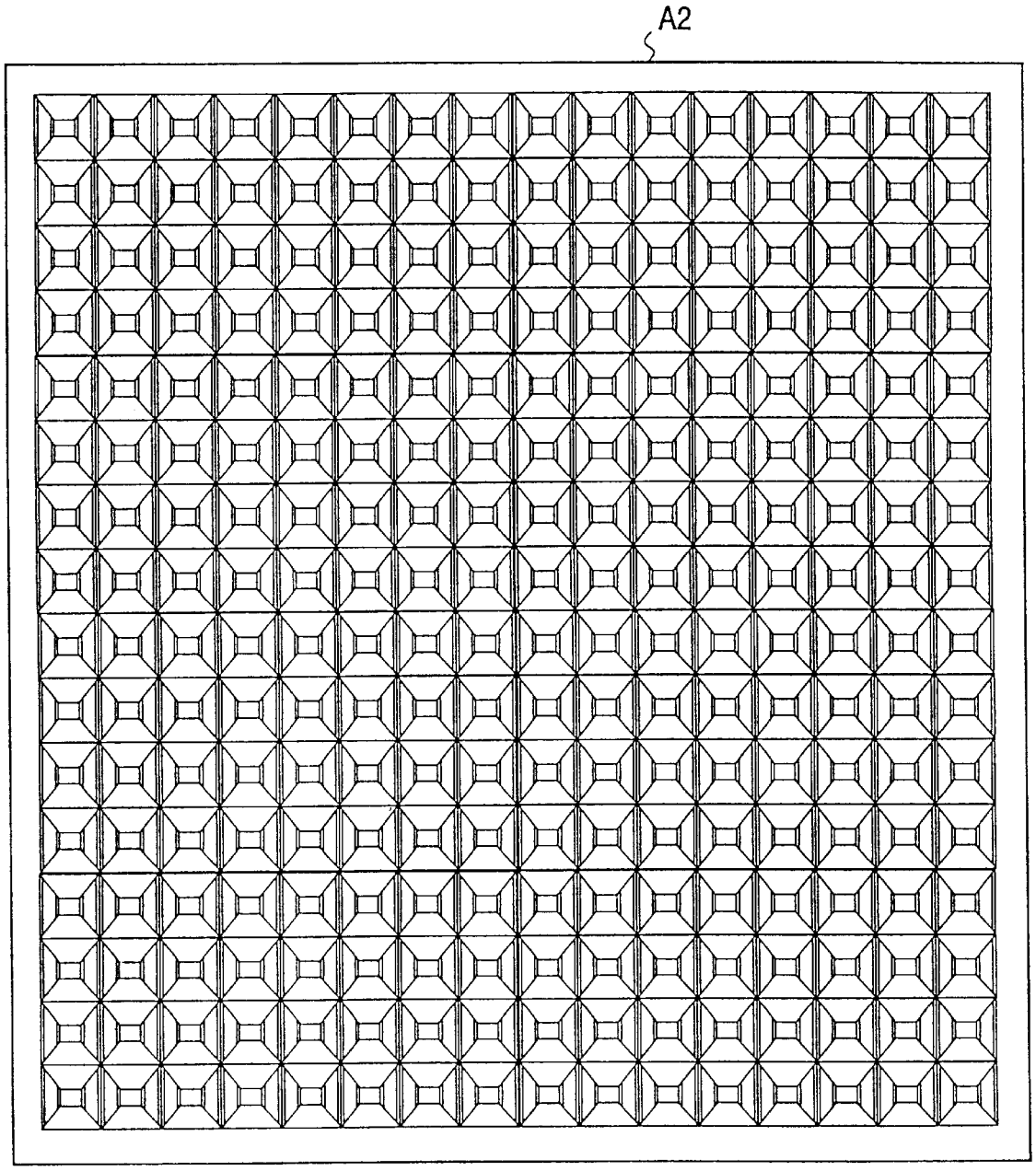
FIG. 9 shows an array of radiating elements designed for the supply network of FIG. 8.

In general, it can be noted that, if there are n radiating elements, power is divided in the supply network in (n−1) T-junctions so that each element is fed by a line having an equal electrical length, if the aforementioned phase correction is not taken into account. FIG. 9 shows (from above) part A2, analogous with part A1 of FIG. 8, which contains a total of 256 radiating elements as in FIG. 7*a*.

In practice, the antenna design according to the invention may be varied, e.g., in the following ways.

In the supply network, it is possible to use different kinds of generally known matching methods and divider structures. The same holds true for dimensioning the waveguide. Wave lines other than a waveguide can also be used.

The coupling of the signal from the supply network to the element can be implemented in various ways, for example, through a probe, if a microstrip is used.

The antenna can be manufactured from various kinds of conductive materials, or by coating a suitable material with a conductive layer. Since the antenna is comprised of two closed parts, casting is, in practice, a noteworthy manufacturing technique. The surfaces of the parts must be conductive and even, to work well. In addition, manufacturing methods exist in which the parts can be casted from plastic and provided with a thin metal coating. Such a method is well suitable for mass production.

By using power dividers described above or other conventional power dividers, it is also possible to influence the relative amplitude of a single radiating element, and accordingly, shape the aperture illumination function as desired.

Although the invention is described above with reference to the examples illustrated in the accompanying drawings, it is obvious that the invention is not restricted thereto, but it may be varied within the inventive idea of the attached claims.

We claim:

1. An antenna, said antenna comprising:

a plurality of radiating elements which radiate electromagnetic energy; and feeders which feed said electromagnetic energy to said radiating elements, said feeders comprise a supply network substantially at the same level in an antenna thickness direction, wherein said radiating elements are arranged next to said supply network in said antenna thickness direction and comprise box horn antennas, said box horn antennas having a step in the plane of the magnetic field.

2. The antenna as claimed in claim 1, said antenna further comprising a first part and a second part, said second part being disposed on said first part, said first part comprising said supply network and said second part comprising said box horn antennas.

3. The antenna as claimed in claim 1, wherein said supply network comprises waveguides, said waveguides having a substantially rectangular cross-section and in which power is divided to said radiating elements by T-junctions.

4. The antenna as claimed in claim 3, wherein at least some of said T-junctions being provided with a triangular divider, said triangular divider having a rounded tip to improve matching.

5. An antenna, said antenna comprising:

a plurality of radiating elements which radiate electromagnetic energy; and feeders which feed said electromagnetic energy to said radiating elements, said feeders comprise a supply network substantially at the same level in an antenna thickness direction, wherein said radiating elements are arranged next to said supply network in said antenna thickness direction and comprise box horn antennas, said box horn antennas having a step in the plane of the magnetic fields, wherein said supply network comprises waveguides, said waveguides having a substantially rectangular cross-section and in which power is divided to said radiating elements by T-junctions, wherein at least some of said T-junctions being provided with a triangular divider, said triangular divider having a rounded tip to improve matching, and wherein at least in some of said T-junctions, said triangular divider, and said feeder guide being shifted sideways in relation to each other so as to alter power distribution from an even distribution.

6. An antenna, said antenna comprising:

a plurality of radiating elements which radiate electromagnetic energy; and feeders which feed said electromagnetic energy to said radiating elements, said feeders comprise a supply network substantially at the same level in an antenna thickness direction, wherein said radiating elements are arranged next to said supply network in said antenna thickness direction and comprise box horn antennas, said box horn antennas having a step in the plane of the magnetic field, and wherein said box horn antennas open linearly in the plane of the magnetic field at least after said step.

7. An antenna, said antenna comprising:

a first planar element;

a second planar element, said second planar element being mounted on top of said first planar element, wherein said second planar element comprising a plurality of horn antennas for radiating electromagnetic energy, each of said box horn antennas having a waveguide with an output and a feeding opening, said output opens to a top surface of said second planar element and said feeding opening opens to a bottom surface of said second planar element, wherein said first planar element comprising a supply network of waveguides on a top surface thereof, said supply network feeds said electromagnetic energy to said box horn antennas through said feeding openings, and wherein each of said box horn antennas comprising a step-like change, said step-like change having a diameter in a direction parallel to the magnetic field of said electromagnetic energy.

8. The antenna as claimed in claim 7, wherein said diameter of said box horn antenna waveguide increases linearly from said step-like change to said top surface of the second planar element.

9. An antenna as claimed in claim 7, wherein said supply network comprises waveguides, said waveguides having a substantially rectangular cross-section and in which power is divided to said radiating elements by T-junctions.

10. An antenna as claimed in claim 8, wherein said supply network comprises waveguides, said waveguides having a substantially rectangular cross-section and in which power is divided to said radiating elements by T-junctions.

11. An antenna as claimed in claim 9, wherein at least some of said T-junctions being provided with a triangular divider, said triangular divider having a rounded tip to improve matching.

12. An antenna as claimed in claim 10, wherein at least some of said T-junctions being provided with a triangular divider, said triangular divider having a rounded tip to improve matching.

13. An antenna as claimed in claim 11, wherein at least some of said T-junctions, said triangular divider, and said feeder guide being shifted sideways in relation to each other so as to alter power distribution from an even distribution.

14. An antenna as claimed in claim 12, wherein at least some of said T-junctions, said triangular divider, and said feeder guide being shifted sideways in relation to each other so as to alter power distribution from an even distribution.

* * * * *